United States Patent [19]

Miller et al.

[11] 4,130,779

[45] Dec. 19, 1978

[54] SLOW RISE TIME WRITE PULSE FOR GAS DISCHARGE DEVICE

[75] Inventors: John W. V. Miller, Toledo; Ray L. Trogdon, Perrysburg, both of Ohio

[73] Assignee: Owens-Illinois, Inc., Toledo, Ohio

[21] Appl. No.: 791,295

[22] Filed: Apr. 27, 1977

[51] Int. Cl.[2] ..... H05B 37/00; H05B 39/00; H05B 41/00

[52] U.S. Cl. ..... 315/169 TV; 340/324 M

[58] Field of Search ..... 315/169 R, 169 TV; 340/324 M

[56] References Cited

U.S. PATENT DOCUMENTS

| | | | |
|---|---|---|---|
| 3,727,102 | 4/1973 | Johnson | 315/169 R |
| 3,833,832 | 9/1974 | Fein et al. | 315/169 TV X |

*Primary Examiner*—Alfred E. Smith
*Assistant Examiner*—Robert E. Wise
*Attorney, Agent, or Firm*—Donald K. Wedding; Myron E. Click; David H. Wilson

[57] ABSTRACT

A gas discharge device having at least one dielectric charge storage member the gaseous medium contacting surface of which consists of a low operating voltage material. The material is used in an amount sufficient to increase the operating life span of the device and/or stabilize the operating voltages of the device. An interface and addressing means is connected to a pair of opposed electrode arrays to energize a plurality of discharge cells, each cell including proximate electrode portions of at least one electrode in each opposed array, said dielectric charge storage member insulating at least one of said proximate electrode portions from said gas. A cell presents a capacitive impedance to a voltage pulse applied by the interface and addressing means to the electrode portions to generate a relatively slow rise time leading edge on the voltage pulse for improved addressing of the cell when the electrode arrays are serially addressed. If at least a portion of the electrodes in one of the arrays are connected for parallel addressing, a keyer pulser connected to these electrodes is turned on to generate a relatively fast rise time leading edge portion on the voltage pulse followed by a relatively slow rise time portion during which the cell is written.

14 Claims, 7 Drawing Figures

SLOW RISE TIME WRITE PULSE FOR GAS DISCHARGE DEVICE

CROSS-REFERENCE TO RELATED APPLICATIONS

The subject matter of this application is related to the subject matter disclosed in applications filed on Jan. 16, 1976 and Feb. 3, 1976, Ser. No. 649,828, now U.S. Pat. No. 4,063,131 and Ser. No. 654,825 respectively, both in the name of John V. Miller, entitled "Slow Rise Time Pulse For Gas Discharge Device", and an application filed on Feb. 12, 1976, Ser. No. 657,494, in the name of Joseph L. Miavecz, entitled "Write Pulse Wave Form For Operating Gas Discharge Device", which applications are incorporated herein by reference.

BACKGROUND OF THE INVENTION

1. Field of the Invention

This invention relates to wave forms for controlling gas discharge devices, especially multiple gas discharge display/memory devices which have an electrical memory and which are capable of producing a visual display or representation of data.

2. Description of the Prior Art

Heretofore, multiple gas discharge display and/or memory panels have been proposed in the form of a pair of dielectric charge storage members which are backed by electrodes, the electrodes being so formed and oriented with respect to an ionizable gaseous medium as to define a plurality of discrete gas discharge units or cells. The cells have been defined by a surrounding or confining physical structure such as the walls of apertures in a perforated glass plate sandwiched between glass surfaces and they have been defined in an open space between glass or other dielectric backed with conductive electrode surfaces by appropriate choices of the gaseous medium, its pressure and the electrode geometry. In either structure charges (electrons and ions) produced upon ionization of the gas volume of a selected discharge cell, when proper alternating operating voltages are applied between the opposed electrodes, are collected upon the surface of the dielectric at specifically defined locations. These charges constitute an electrical field opposing the electrical field which created them so as to reduce the voltage and terminate the discharge for the remainder of the cycle portion during which the discharge producing polarity remains applied. These collected charges aid an applied voltage of the polarity opposite that which created them in the initiation of a discharge by imposing a total voltage across the gas sufficient to again initiate a discharge and a collection of charges. This repetitive and alternating charge collection and ionization discharge constitutes an electrical memory.

An example of a panel structure containing non-physically isolated or open discharge cells is disclosed in U.S. Pat. No. 3,499,167 issued to Theodore C. Baker, et al. Physically isolated cells have been disclosed in the article by D. L. Bitzer and H. G. Slottow entitled "The Plasma Display Panel-A Digitally Addressable Display With Inherent Memory" Proceeding of the Fall Joint Computer Conference, I E E E, San Francisco, Cal., November, 1966, pp 541-547 and in U.S. Pat. No. 3,599,190.

In the operation of the display/memory device an alternating voltage is applied, typically, by applying a first periodic voltage wave form to one array and applying a cooperating second wave form, frequently identical to and shifted on the time axis with respect to the first wave form, to the opposed arrays to impose a voltage across the cells formed by the opposed arrays of electrodes which is the algebraic sum of the first and second wave forms. The cells have a voltage at which a discharge is initiated. That voltage can be derived from an externally applied voltage or a combination of wall charge potential and an externally applied voltage. Ordinarily, the entire cell array is excited by an alternating voltage which, by itself, is of insufficient magnitude to ignite gas discharges in any of the elements. When the walls are appropriately charged, as by means of a previous discharge, the voltage applied across the element will be augmented, and a new discharge will be ignited. Electrons and ions again flow to the dielectric walls extinguishing the discharge; however, on the following half cycle, their resultant wall charges again augment the applied external voltage and cause a discharge in the opposite direction. The sequence of electrical discharge is sustained by an alternating voltage signal that, by itself, could not initiate that sequence. The half amplitude of this sustaining voltage has been designated Vs/2.

In addition to the sustaining voltage, there are manipulating voltages or addressing voltages imposed on the opposed electrodes of a selected cell or cells to alter the state of those cells selectively. One such voltage, termed a "writing voltage", transfers a cell or discharge site from the quiescent to the discharging state by virtue of total applied voltage across the cell sufficient to make it probable that on subsequent sustaining voltage half cycles the cell will be in the "on state". A cell in the "on state" can be manipulated by an addressing voltage, termed an "erase voltage", which transfers it to the "off state" by imposing sufficient voltage to draw off the surface or wall charges on the cell walls and cause them to discharge without being collected on the opposite cell walls in an amount such that succeeding sustainer voltage transistions are not augmented sufficiently by wall charges to ignite discharges.

A common method of producing writing voltages is to superimpose voltage pulses on a sustainer wave form in an aiding direction and cumulatively with the sustainer voltage, the combination having a potential of enough magnitude to fire an "off state" cell into the "on state". Erase voltages are produced by superimposing voltage pulses on a sustainer wave form in opposition to the sustainer voltage to develop a potential sufficient to cause a discharge in an "on state" cell and draw the charges from the dielectric surfaces such that the cell will be in the "off state". The wall voltage of a discharged cell is termed an "off state wall voltage" and frequently is midway between the extreme magnitude limits of the sustainer voltage Vs.

It previously had been discovered that the operating characteristics uniformity and operating life span of a multiple cell gaseous discharge display/memory device can be increased by utilizing a charge storage member with a gas medium contact surface consisting of at least one member selected from oxides of Be, Mg, Ca, Sr, Ba, or Ra. As used herein the gas medium contacting surface is that portion of the dielectric charge storage member which is in direct contact with the ionizable gas medium. Although it is not known whether the charges are stored on the gas contacting surface or sub-surface of the dielectric, the charges at least originate at such surface.

In the fabrication of a gaseous discharge panel, the dielectric material is typically applied to and cured on the surface of a supporting glass substrate or base to which the electrode or conductor elements have been previously applied. The glass substrate may be of any suitable composition such as a soda lime glass composition. In a Baker et al device, two glass substrates containing electrodes and cured dielectric are then appropriately heat sealed together so as to form a panel.

In order to achieve maximum results, the Group IIA oxide layer is continously or discontinuously applied to the gaseous medium contacting surface of the dielectric. In other words, the applied Group IIA oxide layer must be directly exposed to the gaseous medium in order to achieve the desired results. Other metal or metalloid oxide layers may exist below that of the Group IIA oxide layer. Such sub-layers may be of any suitable oxide of the periodic table, especially aluminum oxide, silicon oxide and the rare earth oxides.

SUMMARY

The present invention concerns the operation of a multicelled gas discharge display/memory device having at least one dielectric charge storage member with a low operating voltage gaseous medium contacting surface. The surface is typically formed of at least one Group IIA oxide used in an amount sufficient to increase the operating life span of the device and/or stabilize the operating voltages of the device. An interface and addressing circuit is connected to a pair of opposed electrode arrays to energize a plurality of discharge cells, each cell including proximate electrode portions of at least one electrode in each opposed array, the dielectric charge storage member insulating one of the proximate electrode portions from the gas.

The interface and addressing circuit includes sustainer voltage sources for maintaining a series of discharges in a cell and a pulser-resistor-diode matrix for writing and erasing selected cells. Since the cells present a capacitive impedance to the interface and addressing circuit, keyer pulsers are included to generate a steeply rising leading edge on the write and erase pulses. However, where the low voltage dielectric surface is utilized, the steeply rising write pulses tend to generate crosstalk, that is turn on cells adjacent to the selected cell.

Where the electrodes are serial addressed, the keyer pulsers can be turned off to subject the write pulses to the capacitive impedance of the cells and associated circuits to generate a slow rise time leading edge. However, when the above described addressing techniques are utilized with a multicelled gas discharge display/memory device wherein at least a portion of the electrodes of one of the arrays are parallel addressed, the leading edge of the write pulse is detrimentally altered. In accordance with the present invention, the keyer pulsers connected to the serial addressed electrode array are turned off and the keyer pulsers connected to the parallel addressed electrode array are turned on when the write pulses are generated. The half select portion of the non-keyer write pulse which is applied to the serial addressed electrodes is then subjected to the capacitive impedance of the cells and associated circuits to generate a slow rise time leading edge. However, the half select portion of the keyed write pulse which is applied to the parallel addressed electrodes will be generated with a relatively fast time leading edge. The composite write voltage pulse which appears at a selected cell will have a relatively fast rise time leading edge portion followed by a relatively slow rise time portion during which the cell is turned on. Such write pulses tend to decrease or eliminate crosstalk in the device. In addition, these write pulses increase the size of the window, the pulser-sustainer voltage combinations which result in satisfactory operation of the device. An increase in the duration of the write pulse in conjunction with the slow rise time of that pulse may be utilized to further improve the reliability of the selective manipulation of the charge state of individual cells.

An object of the present invention is to facilitate the control of a multiple gas discharge display/memory device for the manipulation of cell states.

Another object of the present invention is to optimize the dynamic wave forms applied to multicelled gas discharge display/memory devices.

A further object of the present invention is to improve the performance of and increase the tolerance to geometric nonuniformities of reduced firing voltage multicelled gas discharge display/memory devices.

Another object is to achieve more reliable operation of multicelled gas discharge display/memory devices with respect to the selective manipulation of the charge state of individual cells.

DESCRIPTION OF THE PREFERRED EMBODIMENT

Figure 1:
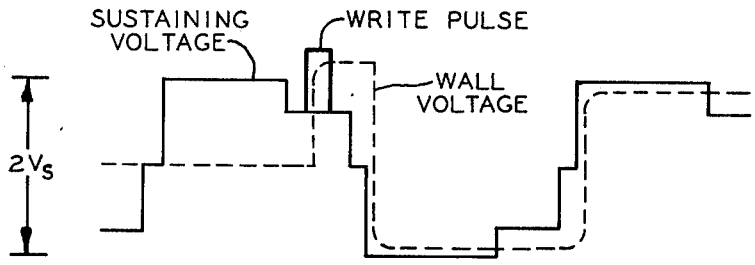
FIG. 1 (PRIOR ART)
FIG. 1 is a generalized prior art sustaining voltage wave form and write pulse plotted against time.

There is shown in FIG. 1 the prior art wave forms associated with the bistable operation of a gas discharge cell. The applied voltage wave form shows a sustaining voltage Vs which is continuously applied to all cells or sites on a panel. The magnitude of the sustaining voltage is insufficient to cause any discharge sites to turn on (i.e. to initiate a stable sequence of discharges), but is sufficient to sustain a discharge sequence once the sequence has been initiated by a "write" pulse applied to the selected site. The magnitude of the "write" pulse must exceed the firing potential of the site and can be applied between the alternate half cycles of the sustaining voltage, superimposed on a half cycle or superimposed on a pedestal as shown in FIG. 1. The utilization of the pedestal with the sustaining voltage wave form allows the use of a smaller magnitude write pulse which can be generated by less expensive electronics.

Because the conducting electrodes are separated from the discharge by a thin layer of insulating dielectric material, the gas discharges occur as short pulses. As the discharge current flows, the electrons and ions accumulate on the insulating surfaces producing an electric field which opposes the field which caused breakdown. The voltage due to these charges on the walls is called the wall voltage. When the polarity of the applied voltage changes, the wall voltage adds to the applied voltage thus producing another discharge pulse. This process repeats every half cycle producing a sequence of discharges which continues indefinitely.

A site may be turned off by applying an appropriate "erase" pulse (not shown) which has the effect of reducing the wall voltage to a level insufficient to reinforce the reversed sustaining voltage to produce a discharge pulse. The sequence of discharge pulses is accompanied by a sequence of light pulses (also not shown). The repetition rate of the light pulses is fast enough so that the light appears steady to the human eye. A typical sustaining voltage frequency is in the range 30–50 kHz. The magnitude of the sustaining voltage must be kept within a certain range, the bistable range. If the sustaining voltage is too low, the discharge sequence will not be maintained. If the sustaining voltage is too high, discharge sites will be turned on by the sustaining voltage alone, thus negating the ability to address selected points on the x—y matrix by the application of a write pulse. The memory of the panel is a consequence of the charges stored on the insulating surfaces. For a given display panel, the limits of the bistable range depend on many parameters such as the composition of the fill gas, the pressure, the panel geometry and panel materials.

Typically, a periodic sustaining voltage sufficient to operate the panel is applied to the opposing electrode arrays, the wave form being rectangular, square, sinusoidal, trapezoidal, triangular, or of any other periodic geometric form or shape. As described in the U.S. Pat. No. 3,727,102 issued to William E. Johnson on Apr. 10, 1973, one half of the sustaining voltage can be applied to one electrode array and the other half can be applied at 180° phase or opposite polarity to the opposing electrode array, the two applied sustaining voltages being algebraically added across the unit. Likewise, all of the sustaining voltage can be applied to only one electrode array.

In the operation of a multiple gas discharge display/memory device which contains opposing electrode arrays, the writing of a particular unit or cell is usually effected by applying a writing voltage to one electrode of the cell and a similar writing voltage to the opposing electrode of the cell. The phase of each writing voltage is such that the two voltages are algebraically added to form a write pulse of sufficient mangitude to turn on the cell. The write voltages are known as partial select voltages. If the writing voltages are derived from the same source, each is equal to the other in magnitude and therefore represents one half of the write pulse. Such write voltages are known as half select voltages. U.S. Pat. No. 3,618,071 issued to William E. Johnson and Larry J. Schmersal on Nov. 2, 1971 discloses a circuit and method for generating partial select voltages to form write pulses.

U.S. Pat. No. 3,801,861 issued to William D. Petty and David E. Liddle on Apr. 2, 1974 discloses wave forms for operating a multiple gaseous discharge panel so as to minimize or eliminate the writing of not-to-be-written cells. One partial select voltage is applied to one electrode of a cell and another partial select voltage is applied to the opposing electrode wherein they are algebraically added across the cell from a near zero slope pedestal. The magnitude of the pedestal is substantially less than the maximum magnitude achieved by the total applied sustaining voltage in one period, and the magnitude of the partial select voltage applied to either opposing electrode alone is insufficient to write any cell in the panel.

A general discussion of the construction and operation of the gas discharge display panel has been disclosed in U.S. Patent Application Ser. No. 649,828, filed on Jan. 16, 1976 and previously incorporated herein by reference.

It is desirous to increase the operating characteristics uniformity and operating life span of a gaseous discharge device. It has been found that such results can be obtained by utilizing a charge storage member with a low operating voltage gas medium contact surface consisting of at least one member selected from the oxides of Be, Mg, Ca, Sr, Ba or Ra as disclosed in U.S. Pat. No. 3,846,171 issued to Bernard W. Byrum, Jr. et al on Nov. 5, 1974 and U.S. Pat. No. 3,863,098 issued to Roger E. Ernsthausen on Jan. 28, 1975, both patents incorporated herein by reference.

One reason for the increase in the operating life span is a substantial reduction in the magnitudes of the operating voltages required to drive the panel. However, it has been found that use of a Group IIA oxide as the gas medium contact surface has a tendency to generate "crosstalk" when a selected cell is being turned on. Crosstalk refers to the turning on of cells adjacent the selected cell when only the selected cell is subjected to the write pulse. The previously identified U.S. Patent Applications Ser. No. 649,828; Ser. No. 654,825; and Ser. No. 657,494 disclose methods and apparatus directed to eliminating crosstalk by utilizing a low rise time write pulse in place of the sharply defined write pulse of FIG. 1. However, these disclosed methods and circuits operate with separately addressed electrodes in a maner known as serial addressing. If at least a portion of the electrodes of one of the arrays are connected in parallel for addressing, the slow rise time leading edge is drastically modified with decreased addressing performance.

Figure 2:
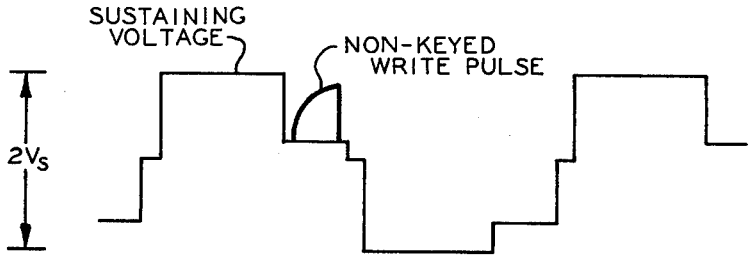
FIG. 2 is a generalized sustaining voltage wave form and the half-select portion of the non-keyed pulse according to the present invention plotted against time.
Figure 3:
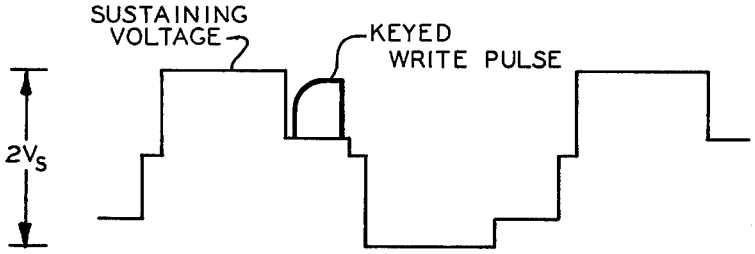
FIG. 3 is a generalized sustaining voltage wave form and the half-select portion of the keyed write pulse according to the present invention plotted against time.
Figure 4:
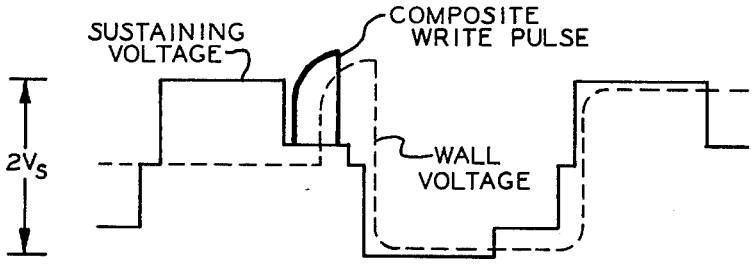
FIG. 4 is a generalized sustaining voltage wave form and the composite write pulse generated from the half-select write pulses of FIGS. 2 and 3 according to the present invention plotted against time.

There is shown in FIGS. 2 through 4 the half select and resultant composite wave forms designed to improve addressing of a gas discharge device having at least a portion of the electrodes in one array addressed in parallel. The natural capacitive impedance of the cells and the associated circuits are used to advantage to generate a write pulse with a relatively fast rise time leading edge portion followed by a relatively slow rise time portion during which the addressed cell is turned on.

Figure 5:
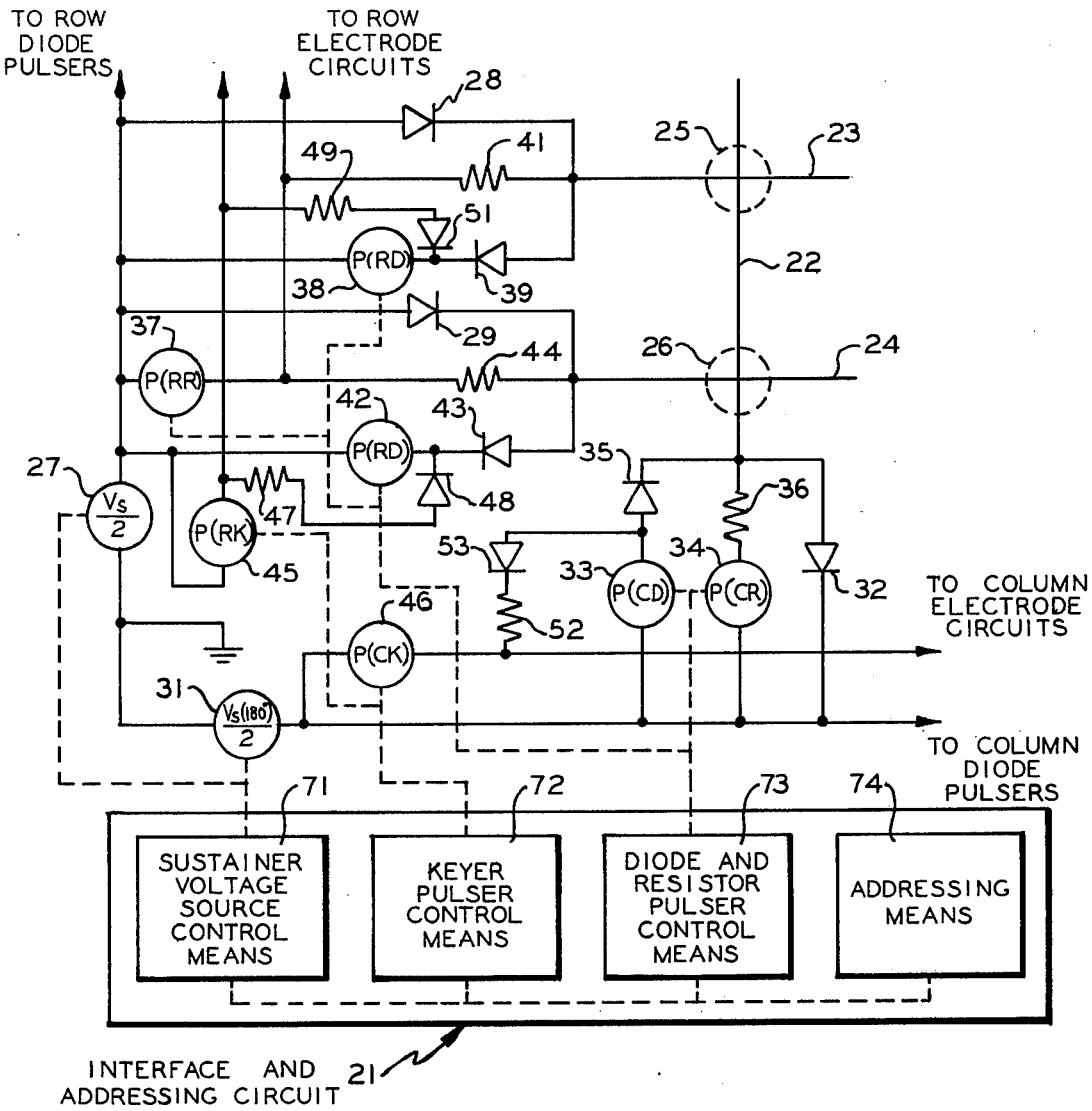
FIG. 5 is a schematic representation of the interface and addressing circuit utilized in the writing and erasing operations of selected cells according to the present invention.

There is shown in FIG. 5 the schematic representation of an interface and addressing circuit used for driving a single column electrode 22 and a pair of adjacent row electrodes 23 and 24 whose intersection with the column electrode defines two adjacent cells or discharge sites. The two cells are represented by a pair of dotted circles 25 and 26. The electrodes are connected to a diode resistor matrix for selecting individual column electrodes and multiple adjacent row electrodes to write and erase selected cells. A pair of sustainer voltage sources are connected between the electrode arrays and the circuit ground potential to supply the sustainer voltage to the cell.

A row sustainer voltage source 27 is connected to the row electrodes 23 and 24 and all other row electrodes (not shown) through a plurality of diodes such as feed through diodes 28 and 29 having anodes connected to the voltage source 27 and cathodes connected to the corresponding electrodes. A column sustainer voltage source 31 is connected to the column electrode 22 and all other column electrodes (not shown) through a plurality of diodes such as feed through diode 32 having a cathode connected to the voltage source 31 and anode connected to electrode 22.

The pulser-diode-resistor circuit for the column electrodes utilizes serial addressing wherein adjacent electrodes are addressed by separate column resistor pulsers. A column diode pulser P(CD) 33 and a column resistor pulser P (CR) 34 are connected in parallel with the diode 32 between the column sustainer voltage source 31 and the column electrode 22. A column diode 35 has an anode connected to the pulser 33 and a cathode connected to the electrode 22. A column resistor 36 is connected between the pulser 34 and the electrode 22. Since the pulsers are connected in series with the sustainer voltage sources between the electrodes and a ground connection, the pulser voltage wave forms will float on the sustainer voltage wave forms and will be referenced from the composite sustainer wave form Vs of FIGS. 1–4.

The pulser-diode-resistor circuit for the row electrodes is similar except that parallel addressing is utilized wherein adjacent electrodes are addressed by the same row resistor pulser. A row resistor pulser P (RR) 37 and a row diode pulser P(RD) 38 are connected in parallel with the diode 28 between the row sustainer voltage source 27 and the row electrode 23. A row diode 39 has an anode connected to the electrode 23 and a cathode connected to the pulser 38. A row resistor 41 is connected between the pulser 37 and the electrode 23. A row diode pulser P(RD) 42 and the pulser 37 are connected in parallel with the diode 29 between the row sustainer voltage source 27 and the row electrode 24. A row diode 43 has an anode connected to the electrode 24 and a cathode connected to the pulser 42. A row resistor 44 is connected between the pulser 37 and the electrode 24. If the cell 26 is selected for writing or erasing, the pulsers 34 and 37 are turned on to generate a voltage pulse and the pulsers 33 and 42 are turned off to block the voltage pulse from returning through them. The pulser 38 is turned on to provide a return path for the voltage pulse to prevent it from reaching the electrode 23 since it is dropped across the row resistor 41.

There is also shown in FIG. 5 a pair of pulsers, a row keyer pulser 45 P(RK) common to all row electrodes and a column keyer pulser P(CK) 46 common to all column electrodes. The row keyer pulser 45 is connected in series with a resistor 47 and a diode 48 in parallel with the row diode pulser 42. The row keyer pulser 45 is also connected in series with a resistor 49 and a diode 51 in parallel with the row diode pulser 38. The column keyer pulser 46 is connected in series with a resistor 52 and a diode 53 in parallel with the column diode pulser 33. The row keyer pulser 45 is connected through a plurality of resistors and diodes to the row diode pulsers for each of the other row electrodes and the column keyer pulser 46 is connected in a similar manner to all of the other column electrodes. The keyer pulser voltage wave forms with float on the sustainer voltage wave forms and will be referenced from the composite sustainer wave form Vs of FIGS. 1 through 4.

The sustainer voltage sources 27 and 31 generate voltages which are 180° out of phase so that each source need supply only one half of the sustainer voltage Vs required to sustain discharges at a selected cell. The voltage sources 27 and 31 continuously generate the Vs/2 and Vs (180°)/2 voltages to the row and column electrodes. These voltages are periodic and can be for example sinusoidal, trapezoidal, square wave (as shown in FIGS. 1 through 4) or triangular. The sustainer wave forms can also be asymmetric as disclosed in U.S. Pat. No. 3,840,779 issued to Jerry D. Schermerhorn on Oct. 8, 1974. The sustainer voltage is passed through the diode pulsers 35, 38 and 42 such that the diodes 28, 29 and 32 provide a current path for one polarity of the sustainer voltage and the diodes 35, 39 and 43 provide a current path for the other polarity of the sustainer voltage such that the sustainer voltage is applied across the cell.

As disclosed in the previously referenced U.S. Pat. No. 3,727,102, the pulsers 33, 34, 37, 38 and 42 are utilized to generate the write and erase pulses for turning on and off respectively the cells defined at the intersection of the electrodes 22, 23 and 24. If the sustaining voltage source 27 is generating a positive polarity wave form with respect to the circuit ground potential and the source 31 is generating a ground potential wave form, the charging current for the cell 44 is flowing through the diodes 28, 29 and 32. The pulsers 37 and 42 generate a negative polarity wave form with respect to the circuit ground potential and the pulsers 33 and 34 generate a positive polarity wave form to generate an erase pulse which has a polarity opposite that of the sustaining voltage. If the sources 27 and 31 are generating ground and positive polarity wave forms respectively, then the pulse generated by the pulsers will be a write pulse since it has the same polarity as the sustaining voltage.

The natural capacitance of the discharge cells and the associated circuitry tends to soften the leading edge of the write and erase pulses. This effect is undesirable where a relatively rapid succession of writing and erasing operations must be performed. Therefore, the row keyer pulser 45 and the column keyer pulser 46 were added to the resistor-diode matrix to improve the rise time of the leading edge of the write and erase pulses. They are connected in parallel to all the row electrodes and column electrodes so that only one pair is required. Where the panel includes a relatively large number of electrodes, more than one pair of keyer pulsers may be required with each one connected to a separate group of electrodes. The keyer pulsers are turned on at the same time that the other pulsers are turned on to generate the steeply rising leading edge shown in the write pulse of FIG. 1. The keyer pulsers are then turned off and, when the other pulsers are turned off, the cell rapidly discharges through the diodes to generate the steeply falling trailing edge of the write and erase pulses.

Where a Group IIA oxide has been utilized as the gaseous medium contacting surface to lower the operating potentials required, it has been found that the steeply rising leading edge of the write pulse of FIG. 1 generates "crosstalk". That is, the write pulse not only turns on the selected cell, but also frequently turns on one or more adjacent cells. In accordance with the present invention, the keyer pulser 46 which is connected to the serial addressed electrode 22 remains turned off during the generation of the write pulses but is turned on during the generation of the erase pulses. The half select portion of the write pulse which is applied to the electrode 22 is then subjected to the capacitive impedance of the cell and the associated circuits to generate a slow rise time leading edge as shown in FIG. 2. However, the keyer pulser 45 which is connected to the parallel addressed electrodes 23 and 24 is turned on during the generation of both the write pulses and the erase pulses. The half select portion of the write pulse which is applied to the parallel addressed electrode will have a relatively uniform fast time leading edge as shown in FIG. 3.

The composite write pulse which appears at the selected cell is shown in FIG. 4 and is the algebraic sum of the two half select pulses. FIG. 4 shows the composite write voltage pulse to have a relatively fast rise time leading edge followed by a relatively slow rise time portion during which the cell is turned on. The slow rise time portion of the write pulse reduces crosstalk and results in improved operation of the panel. If it is desired to adjust the shape of the write pulse to maximize the operation of a particular panel, the magnitude of the keyed select pulse can be fixed at a value just below the half select write magnitude for that axis while the magnitude of the nonkeyed select pulse is adjusted.

Figure 6:
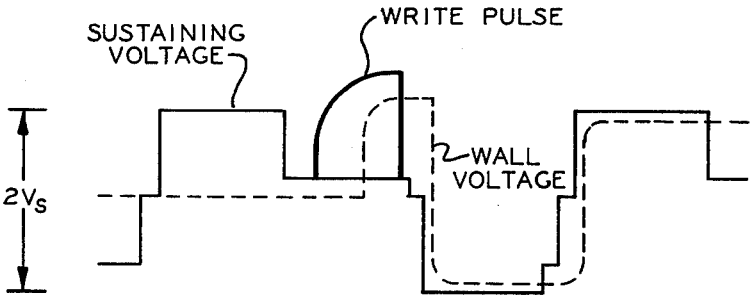
FIG. 6 is a modified sustaining voltage wave form and an extended write pulse according to the present invention plotted against the time scale of FIGS. 1 through 4.

The operation of the panel can be further improved by increasing the duration of the write pulse thereby decreasing the slope of the leading edge. U.S. Pat. No. 3,993,990 issued to John V. W. Miller on Nov. 23, 1976 and incorporated herein by reference, discloses a method and apparatus for altering the sustainer voltage wave form during addressing to provide longer intervals for the transfer of addressed cells between an "on state" and an "off state" of discharge. Sustainer wave forms allow more time for "turn on" and "turn off" partial select signals to be effective by extending the sustainer wave form pedestals on which the partial selects are imposed. These sustainer alterations can be performed by extending the sustainer periods in which addressing is performed or by maintaining the sustainer periods and shortening those portions of the period which are not utilized for addressing as by employing only a "write" pedestal or only an "erase" pedestal. This latter technique is illustrated in FIG. 6 which shows a shortened nonaddressing erase pedestal and an increased duration slow rise time write pulse superimposed on a lenghtened write pedestal.

Figure 7:
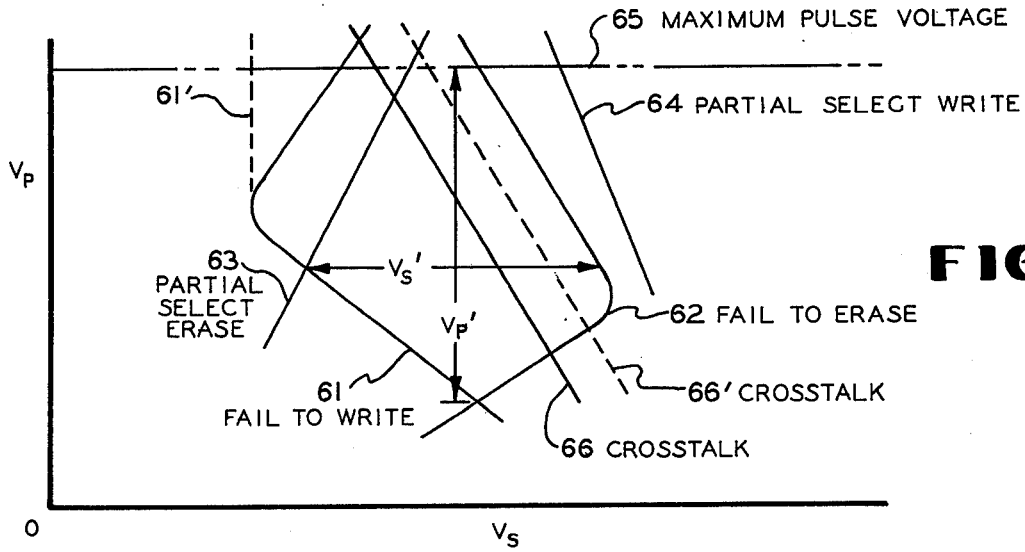
FIG. 7 is a plot of the window data for a typical gaseous discharge panel.

FIG. 7 shows the window data for a typical gaseous discharge panel plotted as write and erase pulse voltage Vp against sustainer voltage Vs. A first hyperbolic-like curve 61 defines the range of pulse voltages versus sustainer voltages for writing the cells in the panel. The area to the left of the curve represents the combinations of write pulse voltage and sustainer voltage for which at least one cell in the panel will fail to write (not turn on) while the area to the right of the curve represents combinations for which all cells will write. If a combination falls in the area to the lower left of the curve 61, the magnitude of the write pulse for a given sustainer voltage is insufficient to initiate a discharge in one or more of the cells. Therefore, the magnitude of the write pulse voltage must be increased to generate a combination to the right of the fail to write curve 61. If the combination falls in the area to the upper left of the curve 61, the magnitude of the write pulse for a given sustainer voltage is sufficient to turn on one or more cells so hard that the wall charge which is formed is unstable and the cell turns itself off. Therefore, the magnitude of the write pulse voltage must be decreased to generate a combination to the right of the fail to write curve 61.

A second hyperbolic-like curve 62 defines the range of pulse voltages versus sustainer voltages for erasing the cells in the panel. The area to the right of the curve represents the combinations of erase pulse voltage and sustainer voltage for which at least one cell in the panel will fail to erase (not turn off) while the area to the left of the curve represents combinations for which all the cells will erase. If a combination falls in the area to the lower right of the curve 62, the magnitude of the erase pulse for a given sustainer voltage is insufficient to discharge the wall charge to turn off one or more of the cells. Therefore, the magnitude of the erase pulse must be increased to generate a combination to the left of the fail to erase curve 62. If a combination falls to the area to the upper right of the curve 62, the magnitude of the erase pulse for a given sustainer voltage is sufficient not only to discharge the wall charge but develop an opposite wall charge to maintain one or more cells in the on state. Therefore, the magnitude of the erase pulse must be decreased to generate a combination to the left of the fail to erase curve 62.

Also shown in FIG. 7 is a partial select erase line 63 and a partial select write line 64. The partial select erase line 63 defines combinations of a partial select erase pulse and a sustainer voltage which will turn off at least one cell in the panel to which only the one partial select erase pulse has been applied. Similarly, the partial select write line 64 defines combinations of a partial select write pulse and a sustainer voltage which will turn on at lease one cell in the panel to which only the one partial select write pulse has been applied. A maximum pulse voltage line 65 defines the upper voltage limit of the electronics which generate the write and erase pulses. The relative positions of the curves 61 and 62 and the lines 63, 64 and 65 form a window which contains all the permissible combinations of pulse voltage and sustainer voltage which will operate all the cells of the panel. The maximum vertical and horizontal dimensions of the window are an indication of the tolerance of the panel to variations from the desired optimum operating pulse and sustainer voltages.

As shown in FIG. 7 for a typical panel, the maximum vertical dimension Vp' is defined by the maximum pulse voltage line 65 and the intersection of the fail to write curve 61 and the fail to erase curve 62. The maximum horizontal dimension Vs' is defined by the fail to erase curve 62 and the intersection of the fail to write curve 61 and the partial select erase line 63. It is desirable to have a relatively large window so that less expensive wider tolerance electronics can be utilized to generate the pulse and sustainer voltages. However, the useful window is reduced by crosstalk shown as a line 66. When the write pulse of FIG. 1 is used, only that portion of the window to the left of the line 66 can be utilized without generating crosstalk in cells adjacent to the selected cell.

When the slow rise time write pulse of FIG. 6 is used however, the crosstalk line 66 is shifted to the right as shown in FIG. 7 by a dashed line 66'. This shift increases the size of the useful portion of the window. The slow rise time pulse also generates an additional benefit. The upper portion of the write curve 61 is modified to be more nearly vertical (shown as dashed line 61') and the curve is shifted to the left to increase the size of the window. The partial select write line 64 is also shifted to the left but does not enter into the definition of the boundaries of the window unless it crosses the fail to erase curve 62.

The interface and addressing circuit 21 includes a sustainer voltage source control means 71, a keyer pulser control means 72, a diode and resistor pulser control means 73 and an addressing means 74 shown in FIG. 5. The sustainer control means 72 enables the sustainer voltage sources 27 and 31 to apply the sustainer voltage to all of the cells in the panel. The addressing means 74 receives information from an external source which can be, for example, a computer, a tape reader or a keyboard. The addressing means 74 then determines which cells are to be written or erased and sends control signals to the keyer pulser control means 72 and the diode and resistor pulser control means 73. If the cell 26 is to be turned on, the control means 72 and 73 sense the timing of the sustainer control means 71 for generating a write pulse. The control means 72 maintains the keyer pulser 46 in a turned off condition and turns on the keyer pulser 45. The control means 73 turns on both the resistor pulsers 34 and 37 and the diode pulser 38 and maintains the diode pulsers 33 and 42 in a turned off condition. Turning off the diode pulsers 33 and 42 prevents the voltage pulses from returning through the pulsers 33 and 42 and forces the voltage pulses to appear at the electrodes 22 and 24.

Since the circuit shown in FIG. 5 utilizes parallel addressing for one electrode array, only two resistor pulsers are necessary to turn on the adjacent cells 25 and 26 simultaneously. If both cells 25 and 26 are to be turned on, the sequence of operation is the same as the foregoing sequence for turning on cell 26 except that the diode pulser 38 is turned off.

If either one of the cells 25 or 26 is to be turned off, the control means 72 turns on both keyer pulsers and the control means 73 turns on the resistor pulsers and maintains the corresponding diode pulsers in an off condition to generate an erase pulse. When generating either a write pulse or an erase pulse, only the diode pulsers connected to the selected cell are turned off. The diode pulsers connected to the electrodes which have not been selected but have an applied resistor pulser voltage are turned on. Turning on the diode pulsers provides a current path back to the resistor pulsers and the voltage pulses will be dissipated across the corresponding row and column resistors and will not appear on the nonaddressed electrodes.

In summary, the present invention concerns a method and apparatus for generating a write pulse having a relatively fast rise time leading edge portion followed by a relatively slow rise time portion. The write pulse is applied to a multicelled gas discharge display/memory device having a dielectric charge storage member formed from a low operating voltage material for improved operation of the device.

The device includes a pair of opposed electrode arrays with proximate electrode portions of at least one electrode in each array defining the cells. An ionizable gas volume is contained between the spaced electrode arrays and a dielectric charge storage member in contact with the gas insulates at least one electrode portion of each cell from the gas. The dielectric charge storage member is formed from a low operating voltage material such as an oxide of a Group IIA element.

A sustainer voltage source is connected across each cell to impose an alternating voltage having a period. During a period the sustainer wave form has a first voltage of a first polarity and a second voltage of a second polarity with a magnitude and duration sufficient to maintain a discharge in any cell which is in the "on state". Also included is pulser means for generating write and erase voltage pulses to manipulate the discharge state of individual cells between the "on state" and an "off state".

The write pulse has a relatively slow rise time portion and the erase pulse has a relatively fast rise time leading edge. The sustainer voltage source generates a third sustainer voltage of the first polarity between the first and second voltages of the same period having a magnitude and duration, when added to the write pulse, sufficient to turn any cell in the "off state" to the "on state". Typically, the duration of the first sustainer voltage is greater than the duration of the third sustainer voltage and the duration of the leading edge of the write pulse approaches the duration of the third sustainer voltage. The sustainer source also generates a fourth sustainer voltage of the second polarity between the second and first voltages of succeeding periods having a magnitude and duration, when added to the erase voltage pulse, sufficient to turn any cell in the "on state" to the "off state".

A keyer pulser means is connected to the pulser means. An interface and addressing circuit controls the operation of the sustainer voltage source, the pulser means and the keyer pulser means. When an addressing means determines that a cell is to be written, it sends control signals to a keyer pulser control means and a diode and resistor pulser control means. The control means sense the timing of a sustainer voltage source control means for generating a write pulse during the generation of the same polarity sustainer voltage. If at least a portion of the electrodes in one array are connected for parallel addressing, a write pulse may be generated by turning on a first keyer pulser means connected to the parallel addressed electrode and by maintaining in the "off state" a second keyer pulser means connected to the other electrode. The resistor and diode pulser means are also turned on and off respectively. These operations generate a write pulse having a relatively fast rise time leading edge portion followed by a relatively slow rise portion. Such write pulses result in improved addressing of a selected cell. When the addressing means determines that a cell is to be erased, it sends control signals to the control means for generating an erase pulse during the generation of the opposite polarity sustainer voltage. The first and second keyer pulser means and the resistor pulser means are turned on and the diode pulser means is turned off to generate across a cell an erase pulse having a relatively fast rise time leading edge.

Therefore, the method of the present invention concerns manipulating the discharge state of individual cells of a gas discharge display/memory device. A periodic alternating polarity sustainer voltage is applied to a cell having a magnitude and duration sufficient to maintain a discharge if the cell is in the "on state". The sustainer wave form can be altered to allow more time for the "turn on" partial select signal by extending the write pedestal. This may be accomplished by extending the sustainer periods or by maintaining the sustainer periods and lengthening the write pedestal while shortening the erase pedestal. Thus, the duration of the third sustainer voltage is increased as can be the duration of the leading edge of the write voltage pulse while the duration of the fourth sustainer voltage is decreased.

In accordance with the provisions of the patent statutes, the principle and mode of operation of the present invention has been explained and what is considered to represent its best embodiment has been illustrated and described. However, it is to be understood that the invention may be practiced otherwise than as specifically illustrated and described without departing from its spirit or scope.

What is claimed is:

1. In an operating system for a multicelled gas discharge display/memory device, said device including a pair of opposed electrode arrays with proximate electrode portions of at least one electrode in each array defining the cells; an ionizable gas volume between the spaced electrode portions of each cell; a dielectric charge storage member in contact with the gas insulating at least one electrode portion of each cell from the gas; a sustainer voltage source connected across each cell to cyclically impose an alternating voltage having a period; pulser means for generating write and erase voltage pulses to manipulate the discharge state of individual cells between an "on state" and an "off state"; and keyer pulser means for generating a steeply rising leading edge on the write and erase voltage pulses, the improvement comprising: said dielectric charge storage member formed from a low operating voltage material; said keyer pulser means including a first keyer pulser connected to one of the electrode arrays and a second keyer pulser connected to the other one of the electrode arrays; and means for maintaining said first keyer pulser in an off condition to generate a relatively slow rise time leading edge on a first half select pulse and for turning on said second keyer pulser to generate a relatively fast rise time leading edge on a second half select pulse, said first and second half select pulses forming said write voltage pulses with a relatively fast rise time leading edge portion followed by a relatively slow rise time leading edge portion whereby crosstalk between adjacent cells is reduced.

2. A system according to claim 1 wherein said low operating voltage material is an oxide selected from the oxides of Group IIA elements.

3. A system according to claim 2 wherein said low operating voltage material is magnesium oxide.

4. A system according to claim 1 wherein at least two of the electrodes of said other electrode array are connected in parallel to said pulser means.

5. A system according to claim 1 wherein said sustainer voltage source generates a first sustainer voltage of a first polarity and a second sustainer voltage of a second polarity having a magnitude and duration during each sustainer period sufficient to maintain a discharge in any cell which is in the "on state" and generates a third sustainer voltage of a said first polarity between said first and second voltages of the same period having a magnitude and duration, when added to said write voltage pulse, sufficient to turn any cell in the "off state" to the "on state".

6. A system according to claim 5 wherein said sustainer voltage source generates a fourth sustainer voltage of said second polarity between said second and first voltages of succeeding periods having a magnitude and duration, when added to said erase voltage pulse, sufficient to turn any cell in the "on state" to the "off state".

7. A system according to claim 5 wherein the duration of said fourth sustainer voltage is less than the duration of said third sustainer voltage.

8. A system according to claim 7 wherein the duration of the leading edge of said write voltage pulse approaches the duration of said third sustainer voltage.

9. A circuit for operating a gas discharge display memory device having a plurality of cells, said device including a pair of opposed electrode arrays with proximate electrode portions of at least one electrode in each array defining the cells; an ionizable gas volume between the spaced electrode portions of each cell; and a dielectric charge storage member having a low operating voltage surface in contact with the gas insulating at least one electrode portion of each cell from the gas, said circuit comprising:

a sustainer voltage source connected between said opposed electrodes for applying an alternating voltage wave form to said cells;

a pulser means connected in series with said sustainer voltage source for generating a write pulse having a relatively fast rise time leading edge portion followed by a relatively slow rise-time leading edge portion; and control and addressing means connected to said pulser means for selecting one of said cells and for directing said pulser means to apply said write pulse or said erase pulse to said selected cell.

10. A circuit according to claim 9 wherein said pulser means includes a first resistor pulser means and a first keyer pulser means connected in parallel to the electrodes of one of said electrodes arrays and a second resistor pulser means connected serially and a second keyer pulser means connected in parallel to the electrodes of the other one of said electrode means and wherein said control and addressing means turns on said first and second resistor pulser means and said first keyer pulser means and maintains said second keyer pulser means in an off condition.

11. A circuit according to claim 10 wherein said control and addressing means turns on said first and second keyer pulser means and said first and second pulser means to generate said erase pulse.

12. A method of manipulating the discharge state of individual cells of a gas discharge display/memory device which comprises:

applying a periodic alternating polarity sustainer voltage to said cells having a magnitude and duration sufficient to maintain a discharge in any cell which is in the "on state".

turning a cell in the "off state" to the "on state" by applying a write voltage pulse having a relatively fast rise time leading edge portion followed by a relatively slow rise time leading edge portion, said write voltage pulse being generated by applying a first half select voltage pulse having a relatively fast rise time leading edge to one electrode of said cell and applying a second half select voltage pulse having a relatively slow rise time leading edge to the other electrode of said cell to form said write voltage pulse; and turning a cell in the "on state" to the "off state" by applying an erase pulse having a relatively fast rise time leading edge.

13. A method according to claim 12 wherein said first half select voltage pulse is generated by turning on pulser means and keyer pulser means connected in parallel to said one electrode and at least one other electrode in the same electrode array and said second half select voltage pulse is generated by turning on a pulser means connected to said other electrode of said cell.

14. A method according to claim 12 wherein said step of turning a cell to the "off state" is performed by turning on a pulser means and a keyer pulser means connected across said cell.

* * * * *